US011214058B2

(12) United States Patent
Watanabe et al.

(10) Patent No.: US 11,214,058 B2
(45) Date of Patent: Jan. 4, 2022

(54) LIQUID EJECTING APPARATUS

(71) Applicant: SEIKO EPSON CORPORATION, Tokyo (JP)

(72) Inventors: Yuki Watanabe, Shiojiri (JP); Hirofumi Teramae, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/080,354

(22) Filed: Oct. 26, 2020

(65) Prior Publication Data

US 2021/0122156 A1 Apr. 29, 2021

(30) Foreign Application Priority Data

Oct. 28, 2019 (JP) ..... JP2019-194997

(51) Int. Cl.
*B41J 29/38* (2006.01)
*B41J 2/045* (2006.01)

(52) U.S. Cl.
CPC ..... *B41J 2/04588* (2013.01); *B41J 2/04581* (2013.01)

(58) Field of Classification Search
CPC ..... B41J 2/04581; B41J 2/04588; B41J 2/04573; B41J 2/04543
See application file for complete search history.

(56) References Cited

U.S. PATENT DOCUMENTS 6,328,395 B1 * 12/2001 Kitahara ..... B41J 2/04541 347/15
2012/0086755 A1 * 4/2012 Sayama ..... B41J 2/04588 347/54
2014/0035979 A1 * 2/2014 Tamura ..... B41J 2/04593 347/11
2015/0022593 A1 * 1/2015 Fukuda ..... B41J 2/04596 347/68
2018/0056648 A1 3/2018 Lahiri et al.

FOREIGN PATENT DOCUMENTS

JP 2010-184355 8/2010
JP 2018-509320 4/2018

* cited by examiner

*Primary Examiner* — Lam S Nguyen
(74) *Attorney, Agent, or Firm* — Workman Nydegger

(57) ABSTRACT

A liquid ejecting apparatus includes a first ejector; a common driving signal generator configured to generate a common driving signal having a pressure generation pulse including a first element maintained at a first potential, a second element succeeding the first element and maintained at a second potential different from the first potential, and a third element succeeding the second element and maintained at a third potential different from the second potential; a selection control signal generator configured to generate a selection control signal including a first pulse and a second pulse succeeding the first pulse in a time period corresponding to the second element; and a driving waveform selector configured to supply the second potential of the second element to the pressure generating element of the first ejector at the time of the generation of a pulse selected from the first and second pulses of the selection control signal.

4 Claims, 7 Drawing Sheets

| | T1 | T2 | T3 | T4 | T5 | T6 | T7 | T8 | T9 | T10 |
|---|---|---|---|---|---|---|---|---|---|---|
| SI | L | L | H | L(H) | H | L | L | L | H | L(H) |

| | T1 | T2 | T3 | T4 |
|---|---|---|---|---|
| SI | L | H | L | H |

LIQUID EJECTING APPARATUS

The present application is based on, and claims priority from JP Application Serial Number 2019-194997, filed Oct. 28, 2019, the disclosure of which is hereby incorporated by reference herein in its entirety.

BACKGROUND

1. Technical Field

The present disclosure relates to a liquid ejecting apparatus.

2. Related Art

In a liquid ejecting apparatus including a plurality of ejectors, cycles of the fluctuation of pressure that is applied to liquids, such as ink, within pressure generating chambers in the ejection of the liquids may vary for the ejectors, depending on dimensions of flow paths including the pressure generating chambers and structures of the pressure generating elements. When the cycles vary, flying speeds of the liquids from the ejectors may vary and an output quality may decrease. Regarding these problems, a technique disclosed in JP-A-2010-184355 measures specific vibration time intervals of ejectors and corrects an ejection driving waveform for driving pressure generating elements based on deviations of results of the measurement, thereby suppressing a variation in flying speeds of liquids.

In the technique disclosed in JP-A-2010-184355, a configuration for supplying the common ejection driving waveform to a plurality of ejectors is used. Therefore, although the ejection driving waveform common to the ejectors can be corrected based on the foregoing deviations, the ejection driving waveform cannot be corrected for and supplied to each of the ejectors.

SUMMARY

According to a first aspect of the disclosure, a liquid ejecting apparatus is provided. The liquid ejecting apparatus includes a first ejector having a nozzle that ejects a liquid, a pressure chamber communicating with the nozzle, and a pressure generating element that causes pressure of the liquid within the pressure chamber to fluctuate. The liquid ejecting apparatus also includes a common driving signal generator configured to generate a common driving signal having a pressure generation pulse including a first element maintained at a first potential, a second element succeeding the first element and maintained at a second potential different from the first potential, and a third element succeeding the second element and maintained at a third potential different from the second potential. The liquid ejecting apparatus also includes a selection control signal generator configured to generate a selection control signal including a first pulse and a second pulse succeeding the first pulse in a time period corresponding to the second element of the pressure generation pulse. The liquid ejecting apparatus also includes a driving waveform selector configured to supply the second potential of the second element of the pressure generation pulse to the pressure generating element of the first ejector at the time of the generation of a pulse selected from the first and second pulses of the selection control signal.

According to a second aspect of the disclosure, a liquid ejecting apparatus is provided. The liquid ejecting apparatus includes a first ejector having a nozzle that ejects a liquid, a pressure chamber communicating with the nozzle, and a pressure generating element that causes pressure of the liquid within the pressure chamber to fluctuate. The liquid ejecting apparatus also includes a common driving signal generator configured to generate a common driving signal having a pressure generation pulse including a first element maintained at a first potential, a second element succeeding the first element and maintained at a second potential different from the first potential, a third element succeeding the second element and maintained at a third potential different from the second potential, and a fourth element succeeding the third element and maintained at a fourth potential different from the third potential. The liquid ejecting apparatus also includes a selection control signal generator configured to generate a selection control signal including a third pulse and a fourth pulse succeeding the third pulse in a time period corresponding to the fourth element of the pressure generation pulse. The liquid ejecting apparatus also includes a driving waveform selector configured to supply the fourth potential of the fourth element of the pressure generation pulse to the pressure generating element of the first ejector at the time of the generation of a pulse selected from the third and fourth pulses of the selection control signal.

DESCRIPTION OF EXEMPLARY EMBODIMENTS

A. First Embodiment

Figure 1:
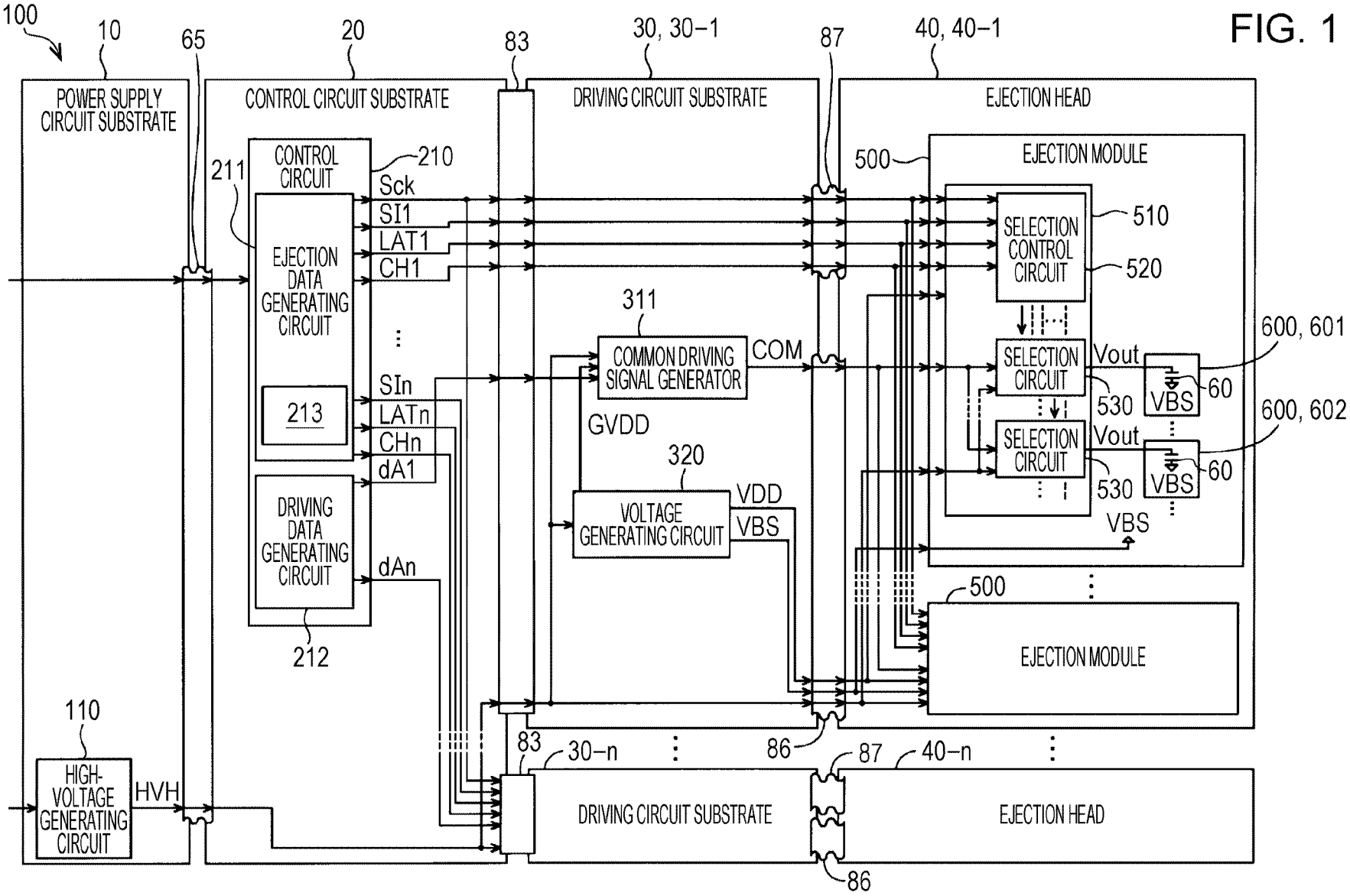
FIG. 1 is a block diagram illustrating an electrical configuration of a liquid ejecting apparatus.

FIG. 1 is a block diagram illustrating an electrical configuration of a liquid ejecting apparatus 100 according to a first embodiment. The liquid ejecting apparatus 100 is, for example, an ink jet printer. The liquid ejecting apparatus 100 includes a power supply circuit substrate 10, a control circuit substrate 20, a plurality of driving circuit substrates 30-1 to **30-*n*, and a plurality of ejecting heads 40-1 to 40-*n***. In this case, n is an integer of 2 or greater and indicates a plural number.

All the driving circuit substrates 30-1 to **30-*n* have the same configuration. When the driving circuit substrates 30-1 to 30-*n* are not distinguished, the driving circuit substrates 30-1 to 30-*n* are referred to as driving circuit substrates 30. All the ejecting heads 40-1 to 40-*n* have the same configuration. When the ejecting heads 40-1 to 40-*n* are not distinguished, the ejecting heads 40-1 to 40-*n* are referred to as ejecting heads 40. In the first embodiment, the driving circuit substrates 30-*i* (i=1 to n) correspond to the ejecting heads 40-*i***, respectively.

A high-voltage generating circuit 110 is mounted on the power supply circuit substrate 10. The power supply circuit substrate 10 is electrically connected to the control circuit substrate 20 via a first cable 65.

The high-voltage generating circuit 110 generates a voltage HVH based on a source voltage input from an external of the liquid ejecting apparatus 100 and outputs the voltage HVH to the control circuit substrate 20. The voltage HVH is used by the liquid ejecting apparatus 100 and is, for example, a voltage signal of DC 42V.

The power supply circuit substrate 10 transmits a signal input from an external host computer of the liquid ejecting apparatus 100 to the control circuit substrate 20.

A control circuit 210 is mounted on the control circuit substrate 20. The control circuit substrate 20 is electrically connected to the driving circuit substrates 30 via B-to-B connectors 83.

The control circuit 210 includes an ejection data generating circuit 211 and a driving data generating circuit 212. When various signals, such as image data, are supplied from the host computer to the control circuit 210 via the power supply circuit substrate 10, the control circuit 210 generates various control signals to control the driving circuit substrates 30 and the ejecting heads 40 or the like and outputs the control signals or the like. In the first embodiment, the ejection data generating circuit 211 includes a selection control signal generator 213.

One or more of the signals input to the control circuit 210 are input to the ejection data generating circuit 211. The ejection data generating circuit 211 generates, based on the one or more input signals, multiple types of control signals to control the ejection of ink from ejectors 600.

Specifically, the ejection data generating circuit 211 generates a number n of print data signals SI1 to SIn and a number n of latch signals LAT1 to LATn to control the timing of ejecting the ink from the ejectors 600. Then, the ejection data generating circuit 211 outputs the print data signals SI1 to SIn and the latch signals LAT1 to LATn to the number n of driving circuit substrates 30-1 to **30-*n*. The selection control signal generator 213 generates a number n of selection control signals CH1 to CHn and outputs the selection control signals CH1 to CHn to the number n of driving circuit substrates 30-1 to 30-*n*. The selection control signals CH are also referred to as change signals. The ejection data generating circuit 211 outputs a common clock signal Sck to the number n of driving circuit substrates 30-1 to 30-*n*. The clock signal Sck, a print data signal SIi, a latch signal LATi, and a selection control signal CHi are input to a driving circuit substrate 30-*i*. The print data signals SI1 to SIn are hereinafter collectively referred to as print data signals SI. The latch signals LAT1 to LATn are hereinafter collectively referred to as latch signals LAT. The selection control signals CH1** to CHn are hereinafter collectively referred to as selection control signals CH.

One or more of the signals input to the control circuit 210 are input to the driving data generating circuit 212. The driving data generating circuit 212 generates, based on the one or more input signals, a number n of driving data dA1 to dAn that is digital data serving as the origin of common driving signals COM to drive the ejectors 600. Then, the driving data generating circuit 212 outputs the driving data dA1 to dAn to the number n of the driving circuit substrates 30-1 to **30-*n*. Driving data dAi is input to a driving circuit substrate 30-*i*. The driving data dA1 to dAn is hereinafter collectively referred to as driving data dA. The driving data dA1 to dAn may be digital data obtained by converting waveforms of driving voltages from analog to digital or may be digital data indicating differences from the latest driving data. The driving data dA1** to dAn may be digital data defining correspondence relationships between lengths of time periods for which inclinations of driving waveforms are fixed and the inclinations of the driving waveforms.

A wiring pattern for branching the voltage HVH generated by the high-voltage generating circuit 110 is mounted on the control circuit substrate 20. The control circuit substrate 20 outputs the voltage HVH to the number n of driving circuit substrates 30-1 to **30-*n*. Specifically, the control circuit substrate 20** functions as a relay substrate configured to branch and transfer the voltage HVH.

The control circuit 210 may be mounted on the power supply circuit substrate 10, instead of being mounted on the control circuit substrate 20. Specifically, the print data signals SI1 to SIn, the latch signals LAT1 to LATn, the selection control signals CH1 to CHn, and the driving data dA1 to dAn may be generated by the power supply circuit substrate 10, instead of being generated by the control circuit 210, and may be input to the control circuit substrate 20 via the first cable 65.

The various signals to be transferred from the power supply circuit substrate 10 to the control circuit substrate 20 via the first cable 65 may be differential signals for which serial control signals are used in Low Voltage Differential Signaling (LVDS) transfer, Low Voltage Positive Emitter Coupled Logic (LVPECL) transfer, Current Mode Logic (CML) transfer, or the like. In this case, a converting circuit configured to convert the various signals to be transferred to the control circuit substrate 20 into the differential signals is mounted on the power supply circuit 10, and a restoring circuit configured to restore the input differential signals is mounted on the control circuit substrate 20.

A common driving signal generator 311 and a voltage generating circuit 320 are mounted on each of the driving circuit substrates 30. Each of the driving circuit substrates 30 is electrically connected to a respective one of the ejecting heads 40 via a second cable 86 and a third cable 87.

Driving data dA and the voltage HVH are input to the common driving signal generator 311. The common driving signal generator 311 has a circuit that generates, based on the input driving data dA and the input voltage HVH, a common driving signal COM to drive a plurality of piezoelectric elements 60 included in the ejecting head 40 and outputs the common driving signal COM to the ejecting head 40.

For example, when the driving data dA is digital data obtained by converting the waveform of the common driving signal COM from analog to digital, the common driving signal generator 311 converts the driving data dA from digital to analog and amplifies the driving data dA based on the voltage HVH to generate the common driving signal COM.

For example, when the driving data dA is digital data defining a correspondence relationship between the length of a time period for which an inclination of the waveform of the common driving signal COM is fixed and the inclination of the waveform of the common driving signal COM, the common driving signal generator 311 generates an analog signal satisfying the correspondence relationship between the length of the time period and the inclination that is defined by the driving data dA. Then, the common driving signal generator 311 amplifies the driving data dA based on the voltage HVH to generate the common driving signal COM.

The voltage generating circuit 320 generates a plurality of voltage signals of a plurality of voltage values based on the voltage HVH. Specifically, the voltage generating circuit 320 generates, as the voltage signals, voltages VBS to be supplied to the piezoelectric elements 60 included in the ejecting head 40 and outputs the voltages VBS to the ejecting head 40. The voltages VBS are, for example, DC 6V. The voltage generating circuit 320 generates, as a voltage signal, a voltage VDD to be used to supply source voltages for various configurations included in the ejecting head 40 and outputs the voltage VDD to the ejecting head 40. The voltage VDD is, for example, DC 3.3V. The voltage generating circuit 320 generates, as a voltage signal, a voltage GVDD to be used to drive an amplifier included in an amplifying circuit included in the common driving signal generator 311 and outputs the voltage GVDD to the common driving signal generator 311. The voltage GVDD is, for example, DC 7.5V. The voltage generating circuit 320 may generate a plurality of voltage signals other than the foregoing voltage signals.

The driving circuit substrate 30 transfers, to the ejecting head 40, the print signal SI, the latch signal LAT, the selection control signal CH, and the clock signal Sck that have been input from the ejection data generating circuit 211.

The driving circuit substrate 30 is electrically connected to the ejecting head 40 via the second cable 86 and the third cable 87. The second cable 86 transfers the common driving signal COM and the voltages VDD and VBS from the driving circuit substrate 30 to the ejecting head 40. The third cable 87 transfers the print data signal SI, the latch signal LAT, the selection control signal CH, and the clock signal Sck from the driving circuit substrate 30 to the ejecting head 40. The second cable 86 and the third cable 87 are unified into a single cable.

The ejecting head 40 includes a plurality of ejection modules 500. Each of the ejection modules 500 includes a driving waveform selector 510 and a plurality of ejectors 600.

The driving waveform selector 510 includes a selection control circuit 520 and a plurality of selecting circuits 530. The driving waveform selector 510 is configured as an integrated circuit, such as an IC, and operates based on the voltage VDD, for example.

The print data signal SI, the latch signal LAT, the selection control signal CH, and the clock signal Sck are input to the selection control circuit 520.

The selection control circuit 520 generates, based on the print data signal SI, selection signals to control output of each waveform element included in the common driving signal COM for each of the selecting circuits 530 and outputs the selection signals based on timing defined by the latch signal LAT and the selection control signal CH.

The common driving signal COM generated by the common driving signal generator 311 is input to each of the selecting circuits 530. The selecting circuits 530 generate driving voltages Vout from the common driving signal COM in accordance with the selection signals output from the selection control circuit 520 and output the driving voltages Vout to the corresponding ejectors 600. The driving voltages Vout are applied to ends of the piezoelectric elements 60.

Each of the ejectors 600 includes a first ejector 601 and a second ejector 602. The ejectors 600 include the piezoelectric elements 60, respectively, and are provided corresponding to the selecting circuits 530, respectively. The driving voltages Vout output from the selecting circuits 530 are applied to the ends of the piezoelectric elements 60, while the voltages VBS are applied to other ends of the piezoelectric elements 60. The piezoelectric elements 60 are deformed based on potential differences between the driving voltages Vout and the voltages VBS and cause ink to be ejected from nozzles 651 included in the ejectors 600 based on the deformations.

Figure 2:
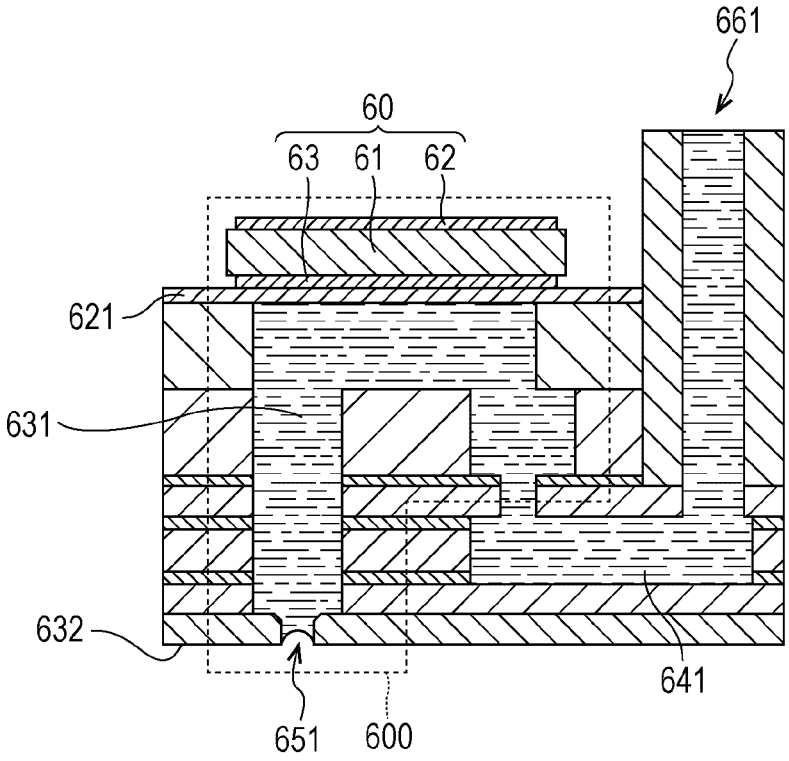
FIG. 2 is a diagram illustrating a schematic configuration of an ejector.

FIG. 2 is a diagram illustrating a schematic configuration of a single ejector 600 included in the ejection module 500. The ejection module 500 includes the ejectors 600 and reservoirs 641.

The reservoirs 641 are provided for colors of ink. The ink is introduced from supply ports 661 into the reservoirs 641. Ink cartridges and ink tanks are connected to the supply ports 661.

Each of the ejectors 600 includes a nozzle 651 that ejects ink as a liquid, a cavity 631 functioning as a pressure chamber and communicating with the nozzle 651, a piezoelectric element 60 as a pressure generating element that causes pressure of the ink within the cavity 631 to fluctuate, and a vibrating plate 621. The vibrating plate 621 bends and vibrates due to the piezoelectric element 60 mounted on an upper surface of the vibrating plate 621 and functions as a diaphragm for increasing and reducing an internal volume of the cavity 631 that is filled with the ink. The nozzle 651 is an opening formed in a nozzle plate 632 and communicating with the cavity 631. The cavity 631 is filled with the ink. The internal volume of the cavity 631 is changed by the deformation of the piezoelectric element 60. The nozzle 651 communicates with the cavity 631 and ejects, as an ink droplet, the ink within the cavity 631 based on the change in the internal volume of the cavity 631.

Each of the piezoelectric elements 60 according to the first embodiment has a structure in which a piezoelectric body 61 is mounted between a pair of electrodes 62 and 63. In FIG. 2, a central portion of the piezoelectric body 61 bends together with the electrodes 62 and 63 and the vibrating plate 621 with respect to both ends of the piezoelectric body 61 in a vertical direction based on a voltage applied by the electrodes 62 and 63. Specifically, when the value of the driving voltage Vout decreases, the piezoelectric element 60 according to the first embodiment bends upward. When the value of the driving voltage Vout increases, the piezoelectric element 60 according to the first embodiment bends downward. In this configuration, when the piezoelectric element 60 bends upward, the internal volume of the cavity 631 increases and ink is drawn from the reservoir 641. On the other hand, when the piezoelectric element 60 bends downward, the internal volume of the cavity 631 decreases and the ink is ejected from the nozzle 651, depending on the degree of decrease.

The piezoelectric element 60 is not limited to the structure illustrated in FIG. 2. It is sufficient if the piezoelectric element 60 is deformed to eject the ink. The piezoelectric element 60 is not limited to the element that bends and vibrates. As the piezoelectric element 60, an element that vibrates in the vertical direction may be used.

In the ejection module 500, the piezoelectric elements 60 are provided corresponding to the cavities 631 and the nozzles 651. Therefore, in the ejection module 500, each of sets of the piezoelectric elements 60, the cavities 631, the nozzles 651, and the selecting circuits 530 is provided for a respective one of the nozzles 651.

Figure 3:
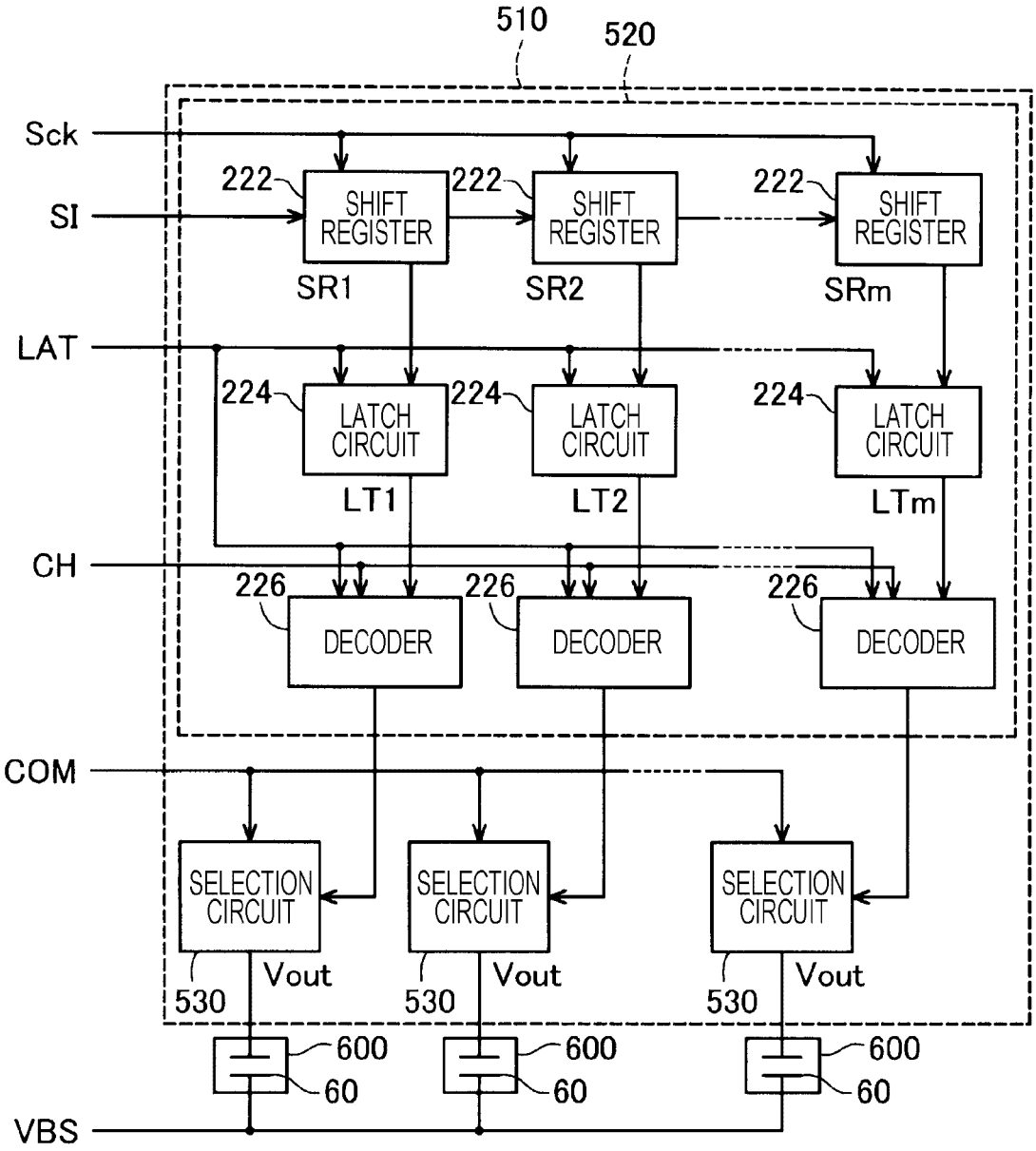
FIG. 3 is a diagram illustrating a configuration of a driving waveform selector.

FIG. 3 is a diagram illustrating a configuration of the driving waveform selector 510. The driving waveform selector 510 includes the selection control circuit 520 and the plurality of selecting circuits 530.

The clock signal Sck, the print data signal SI, the latch signal LAT, and the selection control signal CH are supplied to the selection control circuit 520. In the selection control circuit 520, combinations of shift registers 222, latch circuits 224, and decoders 226 are provided corresponding to the piezoelectric elements 60, respectively. Specifically, the number of the combinations of the shift registers 222, the latch circuits 224, and the decoders 226 in the single driving waveform selector 510 is the same as the total number m of nozzles 651.

The print data signal SI is synchronized with the clock signal Sck. The print data signal SI includes data indicating whether ink is to be ejected or not for each of the number m of ejectors 600.

Each of the shift registers 222 is configured to temporarily hold the print data signal SI. Specifically, the shift registers 222 at stages corresponding to the number of piezoelectric elements 60 are connected in cascade to each other, and the print data signal SI supplied serially is sequentially transferred to the next stages in accordance with the clock signal Sck. In FIG. 3, to distinguish the shift registers 222 from each other, the shift registers 222 are represented by SR1, SR2, . . . , and SRm in order from the shift register 222 located most upstream from where the print data signal SI is supplied.

Each of the number m of latch circuits 224 latches the print data print SI held in each of the number m of shift registers 222 when the latch signal LAT rises.

Each of the number m of decoders 226 switches, based on the print data signal SI latched by each of the number m of latch circuits 224, each of output levels of the selection signals to the selecting circuits 530 to a high (H) level or a low (L) level for each of time periods defined by the latch signal LAT and the selection control signal CH.

The selecting circuits 530 are provided corresponding to the piezoelectric elements 60, respectively. Specifically, the number of selecting circuits 530 included in the single driving waveform selector 510 is the same as the total number m of nozzles 651. When a selection signal is at the H level, a selecting circuit 530 electrically connects the common driving signal generator 311 to a corresponding piezoelectric element 60 and outputs a corresponding portion of the common driving signal COM as a driving voltage Vout. On the other hand, when the selection signal is at the L level, the selecting circuit 530 blocks the electrical connection of the common driving signal generator 311 to the corresponding piezoelectric element 60 and causes the common driving signal generator 311 and the corresponding piezoelectric element 60 to be in an open state. Therefore, a previous voltage is maintained due to the capacitance of the piezoelectric element 60 and serves as the driving voltage Vout.

Figure 4:
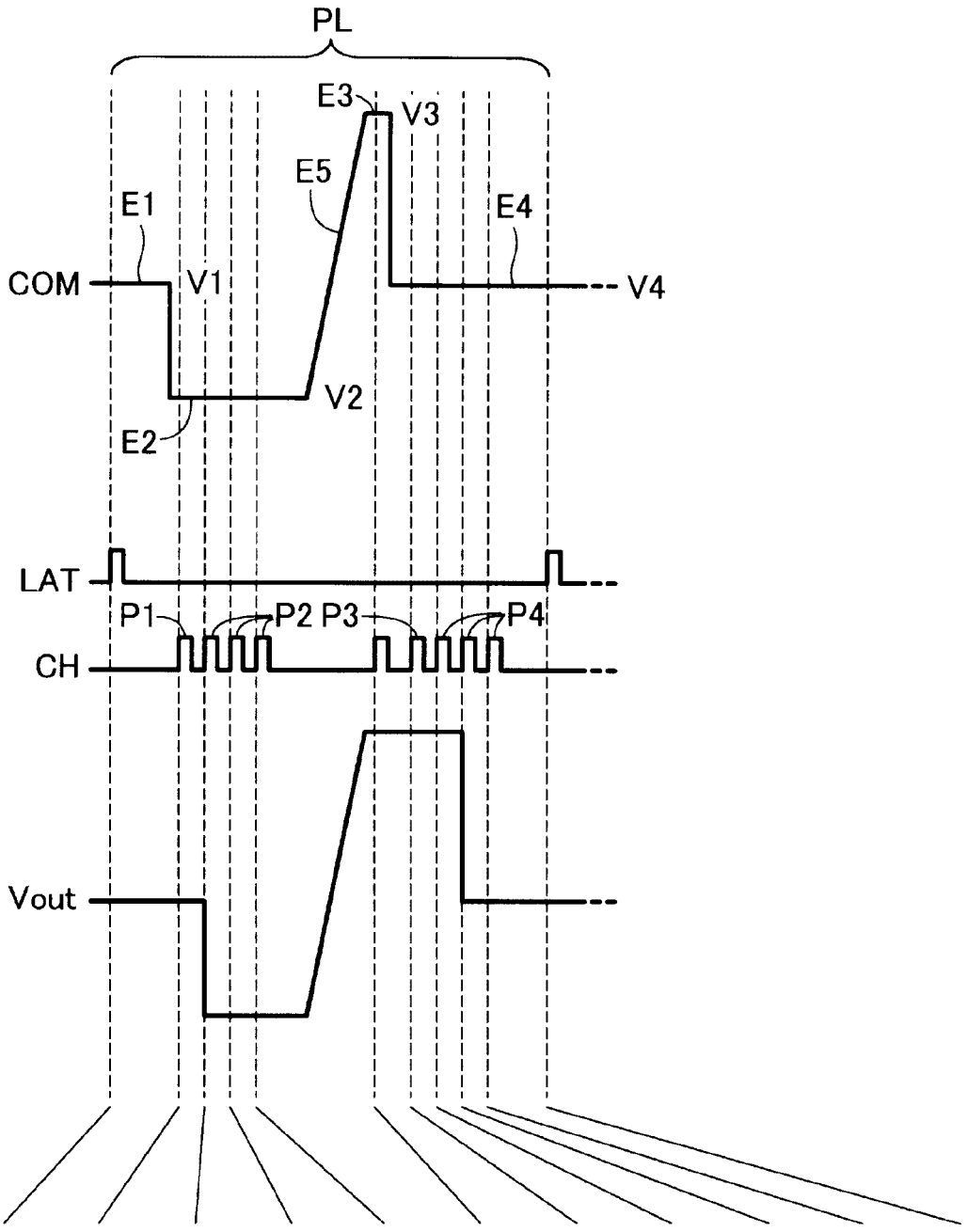
FIG. 4 is a diagram illustrating waveforms of a common driving signal and a driving voltage.

FIG. 4 is a diagram illustrating waveforms of the common driving signal COM and the driving voltage Vout. In the first embodiment, the common driving signal COM includes a pressure generation pulse PL for generating pressure in the cavities 631. The pressure generation pulse PL includes a first element E1, a second element E2, a third element E3, a fourth element E4, and a fifth element E5 as waveform elements.

The first element E1 is a waveform element maintained at a first potential V1. The first potential V1 is, for example, higher than the voltage VBS and equal to the voltage GVDD. The second element E2 is a waveform element succeeding the first element E1 and maintained at a second potential V2 different from the first potential V1. In the first embodiment, the second potential V2 is lower than the first potential V1. The third element E3 is a waveform element succeeding the second element E2 and maintained at a third potential V3 different from the second potential V2. The fifth element E5 is a waveform element set between the second element E2 and the third element E3 and is at a potential changing from the second potential V2 to the third potential V3 with a predetermined gradient after the second potential V2 is maintained for a predetermined time period. In the first embodiment, the third potential V3 is higher than the second potential V2 and higher than the first potential V1. The fourth element E4 is a waveform element succeeding the third element E3 and maintained at a fourth potential V4 different from the third potential V3. In the first embodiment, the fourth potential V4 is lower than the third potential V3 and higher than the second potential V2. In the first embodiment, the fourth potential V4 is equal to the first potential V1.

FIG. 4 illustrates the common driving signal COM, the latch signal LAT, and the selection control signal CH. The latch signal LAT is at the H level for an initial period of a single cycle of the common driving signal COM and is at the L level for the other period of the cycle of the common driving signal COM.

In the first embodiment, the selection control signal CH includes a first pulse P1 and a second pulse P2 succeeding the first pulse P1 in a time period corresponding to the second element E2 of the pressure generation pulse PL. Specifically, the selection control signal CH includes four pulses including the first pulse P1 and the second pulse P2 in the time period corresponding to the second element E2 of the pressure generation pulse PL. The following assumes that the top pulse among the four pulses is the first pulse P1 and the pulses other than the first pulse P1 are second pulses.

In the first embodiment, the selection control signal CH includes a third pulse P3 and a fourth pulse P4 succeeding the third pulse P3 in a time period corresponding to the fourth element E4 of the pressure generation pulse PL. Specifically, the selection control signal CH includes four pulses in the time period corresponding to the fourth element E4 of the pressure generation pulse PL. The following assumes that the top pulse among the four pulses is the third pulse P3 and that the pulses other than the third pulse P3 are fourth pulses. In the first embodiment, the selection control signal CH further includes a single pulse that rises in a time period corresponding to the third element E3.

In the first embodiment, the selection control signal CH includes the nine pulses in the single cycle of the common driving signal COM. Therefore, the common driving signal COM is sectioned into ten time periods T1 to T10 based on the latch signal LAT that rises in the initial period of the single cycle of the common driving signal COM and the selection control signal CH including the nine pulses.

In the first embodiment, the print data signal SI indicates whether the selection signal is set to the L level or the H level for each of the ten time periods T1 to T10. When the print data signal SI indicates "no dot" or indicates that ink is not to be ejected, the selection level is set to the L level by the ejection data generating circuit 211 for all the time periods T1 to T10. In this case, the driving voltage Vout that maintains the first potential V1 across the time periods T1 to T10 is output from the selecting circuit 530 to the corresponding piezoelectric element 60, and ink is not ejected from the corresponding nozzle 651. On the other hand, when the print data signal SI indicates a "dot" or indicates that ink is to be ejected, the selection signal is set to the H level by the ejection data generating circuit 211 for any one of the time periods T2 to T4, the time period T5, and any one of the time periods T7 to T10. Therefore, the driving voltage Vout generated by arbitrarily adjusting, based on the common driving signal COM, the length of a time period for which the first potential V1 of the first element E1 of the pressure generation pulse PL is maintained and the length of a time period for which the third potential V3 of the third element E3 is maintained is output from the selecting circuit 530 to the corresponding piezoelectric element 60.

When the driving voltage Vout is supplied to the piezoelectric element 60, the piezoelectric element 60 bends so that the cavity 631 is expanded to an expanded volume corresponding to the second potential V2 from a steady volume corresponding to the first potential V1, and thus the pressure of ink within the cavity 631 fluctuates at a specific vibration frequency. After that, the piezoelectric element 60 bends according to the fifth element E5 so that the cavity 631 is rapidly contracted to a contracted volume corresponding to the third potential V3. After that, an amount and flying speed of an ink droplet to be ejected from the nozzle 651 change according to the timing of the contraction with respect to the fluctuation of the pressure of the ink within the cavity 631 that has previously occurred. The pressure of the ink within the cavity 631 that has been reduced by the ejection of the ink droplet fluctuates at the specific vibration frequency. After that, the piezoelectric element 60 bends so that the cavity 631 is expanded to a volume corresponding to the fourth potential V4. By matching the timing of the contraction with the timing of increase in the fluctuation of the pressure of the ink within the cavity 631 after the ejection of the ink droplet, it is possible to reduce the fluctuation of the pressure of the ink within the cavity 631 and stabilize the meniscus of the ink.

In the example illustrated in FIG. 4, the selection signal is set to the H level for the time periods T3, T5, and T9. When the driving voltage Vout generated by the adjustment is supplied to the piezoelectric element 60, the piezoelectric element 60 bends so that the cavity 631 is expanded from the steady volume corresponding to the first potential V1 to the expanded volume corresponding to the second potential V2 in the time period T3. The meniscus within the nozzle 651 is drawn toward the cavity 631 by the expansion of the cavity 631. After that, in the time period T5, the piezoelectric element 60 bends so that the cavity 631 is rapidly contracted to the contracted volume corresponding to the third potential V3 when the meniscus within the nozzle 651 moves toward the opposite side to the cavity 631 or toward the side on which the ink is ejected. Therefore, the ink is ejected from the nozzle 651. After that, a portion of the ink is ejected as an ink droplet from the nozzle 651. In the time period T9, the piezoelectric element 60 bends so that the cavity 631 is expanded to the volume corresponding to the fourth potential V4 when the meniscus within the nozzle 651 moves toward the opposite side to the cavity 631 or toward the side on which the ink is ejected. This reduces the fluctuation of the pressure of the ink within the cavity 631 after the ejection of the ink droplet and stabilizes the meniscus. In the example illustrated in FIG. 4, a sign "L(H)" described for each of the time periods T4 and T10 indicates that the same waveform is output regardless of whether the selection signal is at the L level or the H level for the time period.

The fluctuation of the pressure of the ink within the cavity 631 that occurs due to the bending of the piezoelectric element 60 depends on a dimension of a flow path including the cavity 631 and the reservoir 641, the structure of the piezoelectric element 60, and the like. Specific fluctuation cycles of the fluctuation of the pressure of ink within the cavities 631 may be different for the ejectors 600 within the same ejection module 500. When the same driving voltage Vout is supplied to the piezoelectric elements 60 of the plurality of ejectors 600 having different specific fluctuation cycles, the supply of the same driving voltage Vout may cause different ejection characteristics, such as amounts of ink droplets to be ejected from the nozzles 651 of the ejectors 600, flying speeds of the ink droplets, and the like, and may reduce the quality of the printing.

Therefore, a time period that is among the time periods T2 to T4 and T7 to T10 and in which the selection signal is at the H level is determined in advance based on ejection characteristics of ink droplets to be ejected from the nozzles 651. For example, since the timing of drawing the meniscus within the nozzle 651 with respect to the timing of reduction in the pressure of the ink within the cavity 631 by the fifth element E5 can be adjusted by adjusting the timing of setting the selection signal to the H level for the time periods T2 to T4, the amounts and flying speeds of the ink droplets can be finely adjusted. By adjusting the timing of setting the selection signal to the H level for the time periods T7 to T10, the timing of canceling the vibration of the meniscus by the deformation of the piezoelectric element 60 after the ejection can be adjusted. Specifically, ejection characteristics of the ejectors 600 can be uniform by adjusting the print data signal SI to be output from the ejection data generating circuit 211 for each of the ejectors 600 in advance according to an experiment or the like based on ejection characteristics of ink droplets to be ejected from the nozzles 651. In the first embodiment, in the foregoing configuration, the driving waveform selector 510 can supply the second potential V2 of the second element E2 of the pressure generation pulse P1 to the piezoelectric element 60 of the ejector 600 at the time of the generation of a pulse arbitrarily selected from the first and second pulses P1 and P2 included in the selection control signal CH. In addition, the driving waveform selector 510 can supply the fourth potential V4 of the fourth element E4 of the pressure generation pulse PL to the piezoelectric element 60 of the ejector 600 at the time of the generation of a pulse arbitrarily selected from the third and fourth pulses P3 and P4 included in the selection control signal CH.

In the first embodiment, different pulses can be selected as the timing of changing the potential from the plurality of pulses included in the selection control signal CH for each of the ejectors 600 by changing details of the print data signal SI. Therefore, the driving waveform selector 510 can supply the second potential V2 of the second element E2 of the pressure generation pulse PL to a piezoelectric element 60 of a first ejector 601 at the time of the generation of the first pulse P1 of the selection control signal CH. The driving waveform selector 510 can supply the second potential V2 of the second element E2 of the pressure generation pulse PL to a piezoelectric element 60 of a second ejector 602 different from the first ejector 600 at the time of the generation of the second pulse P2 of the selection control signal CH. Furthermore, the driving waveform selector 510 can supply the fourth potential V4 of the fourth element E4 of the pressure generation pulse PL to the piezoelectric element 60 of the first ejector 600 at the time of the generation of the third pulse P3 of the selection control signal CH. In addition, the driving waveform selector 510 can supply the fourth potential V4 of the fourth element E4 of the pressure generation pulse PL to the piezoelectric element 60 of the second ejector 602 different from the first ejector 600 at the time of the generation of the fourth pulse P4 of the selection control signal CH.

According to the liquid ejecting apparatus 100 according to the first embodiment described above, the waveform of the pressure generation pulse PL included in the common driving signal COM can be corrected for each of the ejectors 600 and output as the driving voltages Vout for each of the ejectors 600 by selecting an arbitrary pulse as the timing of changing the potential using the print data signal SI from the plurality of pulses of the selection control signal CH that are included in the time periods corresponding to the second and fourth elements E2 and E4 of the pressure generation pulse PL. Therefore, the common driving signal generator 311 that generates the common driving signal COM is not provided for each of the ejectors 600 and can drive the piezoelectric elements 60 for each of the ejectors 600 based on the characteristics of the ejectors 600. As a result, while the ejection characteristics of the plurality of ejectors 600 depend on dimensions of flow paths including the cavities 631 and the reservoirs 641 and the structures of the piezoelectric elements 60, it is possible to suppress a variation in the ejection characteristics of the plurality of ejectors 600 and improve the output quality of the liquid ejecting apparatus 100.

B. Second Embodiment

Figure 5:
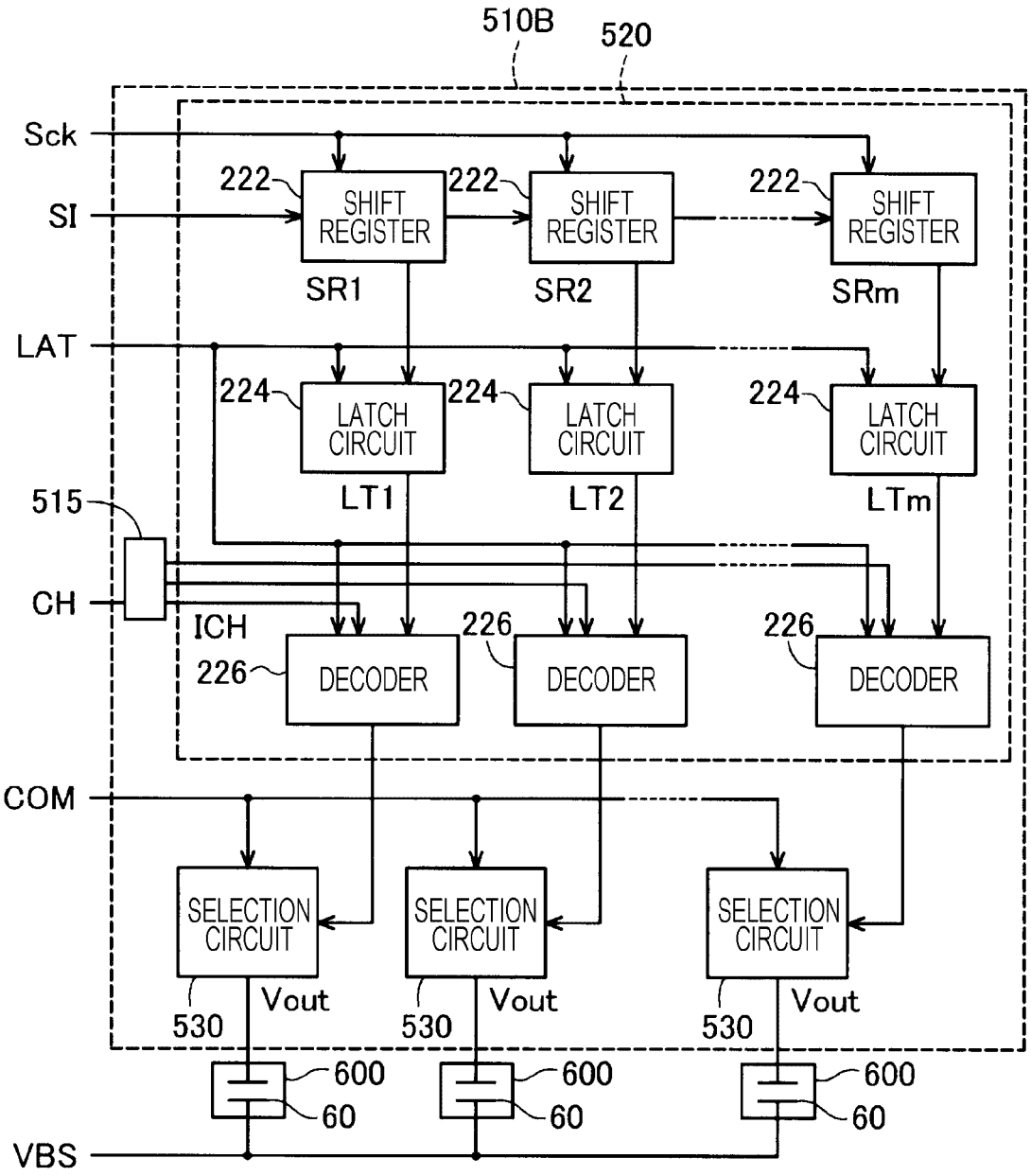
FIG. 5 is a diagram illustrating a configuration of a driving waveform selector according to a second embodiment.

FIG. 5 is a diagram illustrating a configuration of a driving waveform selector 510B according to a second embodiment. The driving waveform selector 510B according to the second embodiment includes an individual selection control signal generator 515 that generates an individual selection control signal. This feature is different from the first embodiment. An entire configuration of a liquid ejecting apparatus 100 according to the second embodiment is the same as or similar to the configuration illustrated in FIG. 1 and described in the first embodiment.

Figure 6:
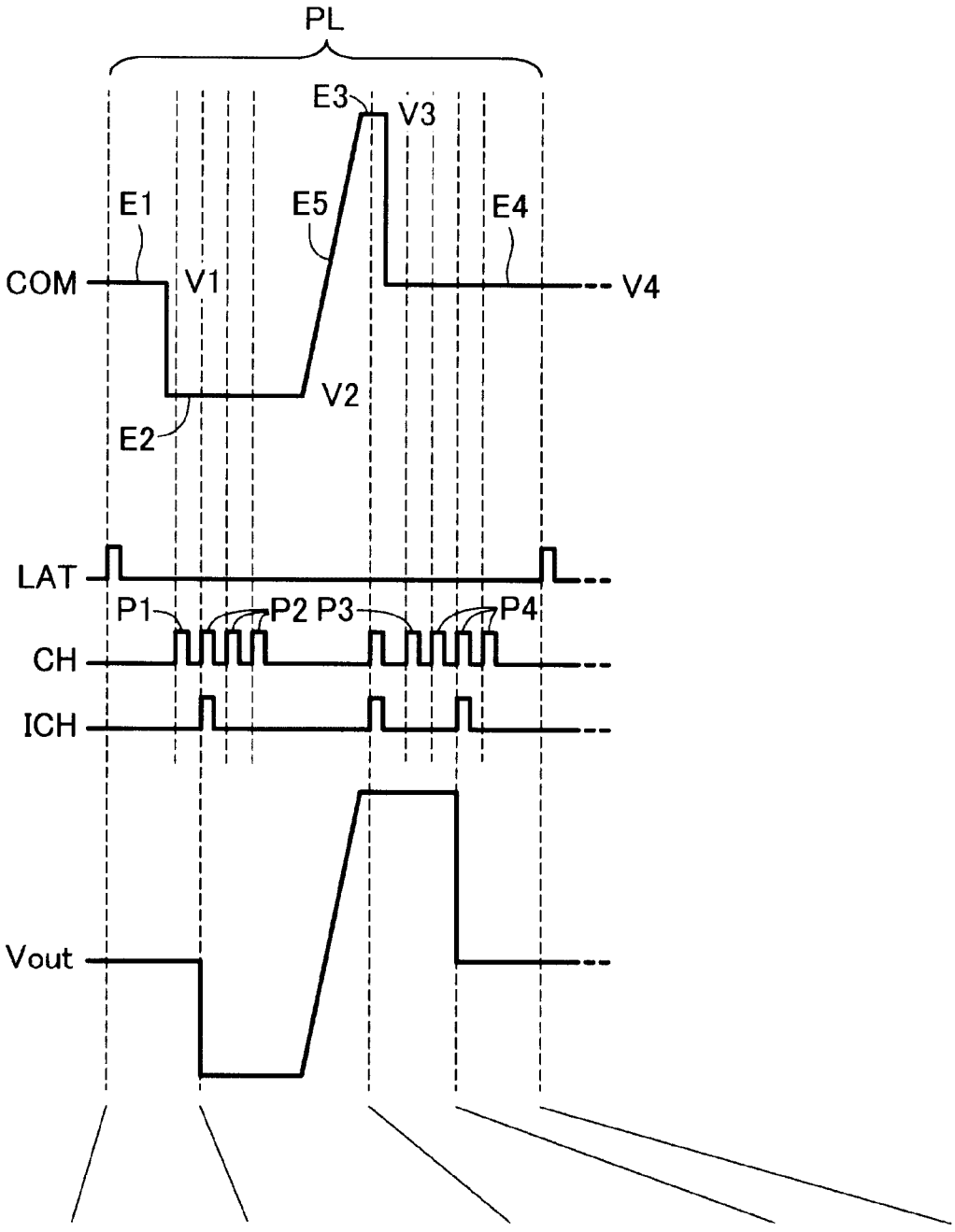
FIG. 6 is a diagram illustrating waveforms of a common driving signal and a driving voltage according to the second embodiment.

FIG. 6 is a diagram illustrating waveforms of a common driving signal COM and a driving voltage Vout according to the second embodiment. The waveforms of the common driving signal COM and the driving voltage Vout are the same as those illustrated in FIG. 4 and described in the first embodiment.

FIG. 6 illustrates the latch signal LAT, the selection control signal CH, and an individual selection control signal ICH. The latch signal LAT is the same as the latch signal LAT illustrated in FIG. 4 and described in the first embodiment, and the selection control signal CH is the same as the selection control signal illustrated in FIG. 4 and described in the first embodiment. The individual selection control signal ICH is output from the individual selection control signal generator 515 illustrated in FIG. 5 for each of the ejectors 600.

The individual selection control signal generator 515 selects, for each of the ejectors 600, a pulse from the first and second pulses P1 and P2 included in the selection control signal CH and selects, for each of the ejectors 600, a pulse from the third and fourth pulses P3 and P4 included in the selection control signal CH. The individual selection control signal generator 515 outputs, for each of the ejectors 600, an individual selection control signal ICH generated by extracting, from the selection control signal CH, pulses selected from the first to fourth pulses P1 to P4 and a pulse that rises in a time period corresponding to the third element E3 to the decoder 226 corresponding to the ejector 600. Specifically, in the second embodiment, individual selection control signals ICH associated with the ejection characteristics of the ejectors 600 are input to the decoders 226 within the same ejection module 500, instead of the common selection control signal CH. Data indicating pulses to be used among the pulses included in the selection control signal CH for each of the ejectors 600 is adjusted in advance according to an experiment or the like based on the ejection characteristics of the ejectors 600 and is, for example, stored in a storage section included in the driving waveform selector 510.

As illustrated in FIG. 6, in the second embodiment, the individual selection control signal ICH includes three pulses in a single cycle of the common driving signal COM. Therefore, the common driving signal COM is sectioned into four time periods T1 to T4 in total based on the latch signal LAT that rises in an initial period of the single cycle of the common driving signal COM and the individual selection control signal ICH having the three pulses.

In the second embodiment, the print data signal SI indicates whether the selection signal is set to the L level or the H level for each of the four time periods T1 to T4. When the print data signal SI indicates "no dot" or indicates that ink is not to be ejected, the selection signal is set to the L level by the ejection data generating circuit 211 for all the time periods T1 to T4. Then, the driving voltage Vout that maintains the first potential V1 across the time periods T1 to T4 is output from the selecting circuit 530 to the corresponding piezoelectric element 60, and thus ink is not ejected from the corresponding nozzle 651. On the other hand, when the print data signal SI indicates a "dot" or indicates that the ink is to be ejected, the print data signal SI indicating that the selection signal is at the L level for the time period T1, the H level for the time period T2, the L level for the time period T3, and the H level for the time period T4 is output by the ejection data generating circuit 211. Thus, the driving voltage Vout obtained by arbitrarily adjusting the length of a time period for which the first potential V1 of the first element E1 is maintained and the length of a time period for which the third potential V3 of the third element E3 is maintained based on the timing of the pulses included in the individual selection control signal ICH is output from the selecting circuit 530 to the corresponding piezoelectric element 60. Therefore, since the timing of drawing the meniscus within the nozzle 651 with respect to the timing of reduction in the pressure of the ink within the cavity 631 by the fifth element E5 can be adjusted in the same manner as the first embodiment, an amount and flying speed of an ink droplet to be ejected from the nozzle 651 can be finely adjusted. In addition, the timing of canceling the vibration of the meniscus after the ejection of the ink droplet from the nozzle 651 can be adjusted.

In the second embodiment described above, the waveform of the pressure generation pulse PL included in the common driving signal COM can be adjusted for each of the ejectors 600 and output as the driving voltages Vout, like the first embodiment, and the piezoelectric elements 60 can be driven based on the characteristics of the ejectors 600. As a result, it is possible to suppress a variation in the ejection characteristics of the plurality of ejectors 600 and improve the output quality of the liquid ejecting apparatus 100.

In the second embodiment, since the number of selection signals can be reduced to a required number by using the individual selection control signals ICH associated with the characteristics of the ejectors 600 and composed of pulses selected from the selection control signal CH, a data length of the print data signal SI can be reduced. It is, therefore, possible to reduce a time period required for data transfer and increase a printing speed.

Figure 7:
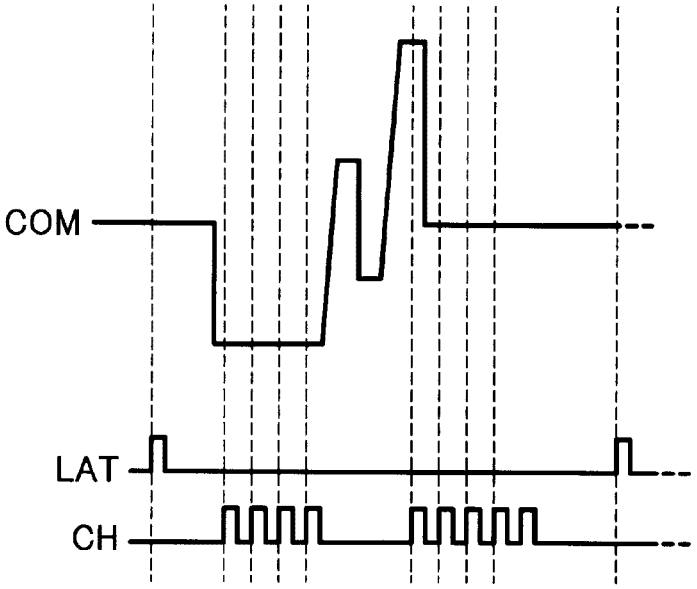
FIG. 7 is a diagram illustrating an example of a pressure generation pulse.

C. Other Embodiments (C-1) The waveform of the pressure generation pulse PL included in the common driving signal COM according to each of the foregoing embodiments is not limited to the waveform illustrated in FIGS. 4 and 6. For example, the potentials of the waveform elements included in the pressure generation pulse PL and magnitude relationships between the potentials vary depending on the configurations of the piezoelectric elements 60 and structures of the flow paths of the ejectors 600. In addition, as illustrated in FIG. 7, the pressure generation pulse PL may have a waveform so that the pressure generation pulse PL falls, rises, falls, and rises again, for example. According to this waveform, a smaller ink droplet than that to be ejected according to the waveform illustrated in FIGS. 4 and 6 can be ejected. When an arbitrary pulse is selected from the selection control signal CH, the timing of the initial falling and the timing of the falling after the second rising in the foregoing waveform can be changed for each of the ejectors 600, for example.

It is sufficient if the waveform of the pressure generation pulse PL included in the common driving signal COM enables the ink to be ejected from the nozzles 651. The waveform of the pressure generation pulse PL included in the common driving signal COM is not limited to the waveforms illustrated in FIGS. 4, 6, and 7. For example, the pressure generation pulse PL included in the common driving signal COM may have a waveform with a simple shape, such as a trapezoidal or rectangular shape.

Figure 8:
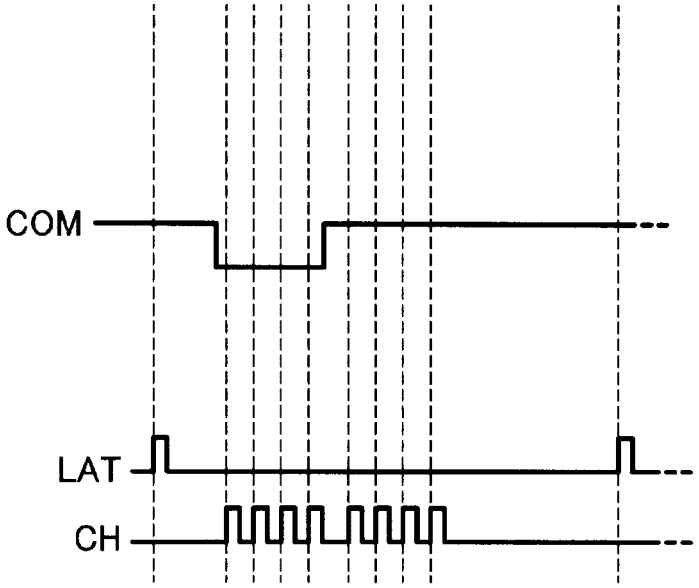
FIG. 8 is a diagram illustrating an example of a micro-vibration generation pulse.

For example, the common driving signal COM may include a micro-vibration generation pulse for causing the meniscus within the nozzles 651 to finely vibrate when the ink is not ejected, as illustrated in FIG. 8. In a present embodiment, the micro-vibration generation pulse has a waveform with a substantially rectangular shape. Even according to this waveform, by selecting an arbitrary pulse from the selection control signal CH having the plurality of pulses, it is possible to suppress a variation in micro-vibration characteristics of the plurality of nozzles 651 when ink is not ejected.

(C-2) In the foregoing embodiments, the single pressure generation pulse PL is included in the single cycle of the common driving signal COM. However, a plurality of pressure generation pulses PL may be included in the single cycle of the common driving signal COM. The plurality of pressure generation pulses PL may have waveforms with the same shape or may have waveforms with different shapes. In addition, the pressure generation pulse PL and the micro-vibration generation pulse illustrated in FIG. 8 may be included in the single cycle of the common driving signal COM. Even when a plurality of waveforms are included in the single cycle of the common driving waveform COM, a variation in the ejection characteristics of the ejectors 600 can be suppressed by causing a plurality of pulses to be included in the selection control signal CH for each waveform.

(C-3) In the foregoing embodiments, elements with resistance components may be mounted between the selecting circuits 530 and the ejectors 600 in wiring paths through which the driving voltages Vout flow so that the inclination of a change in the potential from the first potential V1 to the second potential V2 and the inclination of a change in the potential from the third potential V3 to the fourth potential V4 are desirable. By mounting the elements, it is possible to suppress rapid deformations of the piezoelectric elements 60.

(C-4) In the foregoing embodiments, the timing of supplying the second potential V2 of the second element E2 of the pressure generation pulse PL from the selecting circuits 530 to the ejectors 600 and the timing of supplying the fourth potential V4 of the fourth element of the pressure generation pulse PL from the selecting circuits 530 to the ejectors 600 can be adjusted. However, only either the timing of supplying the second potential V2 or the timing of supplying the fourth potential V4 may be adjustable. Specifically, the selection control signal CH may include the first pulse P1 and the second pulse P2 and may not include the third pulse P3 and the fourth pulse P4. Alternatively, the selection control signal CH may include the third pulse P3 and the fourth pulse P4 and may not include the first pulse P1 and the second pulse P2.

(C-5) In the foregoing embodiments, the selection control signal CH includes the plurality of pulses in the time period corresponding to the second element E2 of the pressure generation pulse PL and includes the plurality of pulses in the time period corresponding to the fourth element E4 of the pressure generation pulse PL. However, the selection control signal CH may include a pulse in a time period corresponding to another waveform element. The selection control signal CH may include a plurality of pulses that repeatedly rise at time intervals equal to or shorter than those of the clock signal Sck. In these cases, the print data signal SI corresponding to the selection signal for each of the plurality of time periods defined by the latch signal LAT and the selection control signal CH can be used to select the timing of supplying the common driving signal COM as the driving voltages Vout to the piezoelectric elements 60 based on the ejection characteristics of the ejectors 600, like the first embodiment. Pulses that constitute the individual selection control signals ICH based on the ejection characteristics of the ejectors 600 can be selected by the individual selection control signal generator 515, like the second embodiment.

(C-6) The liquid ejecting apparatuses 100 according to the foregoing embodiments eject ink. The liquid ejecting apparatuses 100, however, are not limited to the apparatuses that eject ink. Each of the liquid ejecting apparatuses 100 may eject a liquid other than ink.

D. Other Aspects

The disclosure is not limited to the foregoing embodiments and can be achieved with various configurations without departing from the gist of the disclosure. For example, the technical characteristics according to the embodiments that correspond to technical characteristics described in the following aspects may be replaced or combined when necessary in order to solve some or all of the foregoing problems or achieve some or all of the foregoing effects. A technical characteristic that is among the technical characteristics and is not described as an essential characteristic may be removed.

(1) According to a first aspect of the disclosure, a liquid ejecting apparatus is provided. The liquid ejecting apparatus includes a first ejector having a nozzle that ejects a liquid, a pressure chamber communicating with the nozzle, and a pressure generating element that causes pressure of the liquid within the pressure chamber to fluctuate. The liquid ejecting apparatus also includes a common driving signal generator configured to generate a common driving signal having a pressure generation pulse including a first element maintained at a first potential, a second element succeeding the first element and maintained at a second potential different from the first potential, and a third element succeeding the second element and maintained at a third potential different from the second potential. The liquid ejecting apparatus also includes a selection control signal generator configured to generate a selection control signal including a first pulse and a second pulse succeeding the first pulse in a time period corresponding to the second element of the pressure generation pulse. The liquid ejecting apparatus also includes a driving waveform selector configured to supply the second potential of the second element of the pressure generation pulse to the pressure generating element of the first ejector at the time of the generation of a pulse selected from the first and second pulses of the selection control signal.

According to the first aspect, a pulse suitable for each of ejectors is selected from a plurality of pulses of the selection control signal included in a time period corresponding to the second element of the pressure generation pulse, and thus the waveform of the pressure generation pulse included in the common driving signal can be corrected for and supplied to each of the ejectors.

(2) In the foregoing first aspect, the liquid ejecting apparatus may further include a second ejector having a nozzle that ejects a liquid, a pressure chamber communicating with the nozzle, and a pressure generating element that causes pressure of the liquid within the pressure chamber to fluctuate, and the driving waveform selector may be configured to supply the second potential of the second element of the pressure generation pulse to the pressure generating element of the first ejector at the time of the generation of the first pulse of the selection control signal and supply the second potential of the second element of the pressure generation pulse to the pressure generating element of the second ejector at the time of the generation of the second pulse of the selection control signal.

According to the foregoing first aspect, when an ejection characteristic of the first ejector is different from an ejection characteristic of the second ejector, it is possible to suppress a variation in the ejection characteristics of the first and second ejectors.

(3) According to a second aspect of the disclosure, a liquid ejecting apparatus is provided. The liquid ejecting apparatus includes a first ejector having a nozzle that ejects a liquid, a pressure chamber communicating with the nozzle, and a pressure generating element that causes pressure of the liquid within the pressure chamber to fluctuate. The liquid ejecting apparatus also includes a common driving signal generator configured to generate a common driving signal having a pressure generation pulse including a first element maintained at a first potential, a second element succeeding the first element and maintained at a second potential different from the first potential, a third element succeeding the second element and maintained at a third potential different from the second potential, and a fourth element succeeding the third element and maintained at a fourth potential different from the third potential. The liquid ejecting apparatus also includes a selection control signal generator configured to generate a selection control signal including a third pulse and a fourth pulse succeeding the third pulse in a time period corresponding to the fourth element of the pressure generation pulse. The liquid ejecting apparatus also includes a driving waveform selector configured to supply the fourth potential of the fourth element of the pressure generation pulse to the pressure generating element of the first ejector at the time of the generation of a pulse selected from the third and fourth pulses of the selection control signal.

According to the foregoing second aspect, a pulse suitable for each of ejectors is selected from a plurality of pulses of the selection control signal included in a time period corresponding to the fourth element of the pressure generation pulse, and thus the waveform of the pressure generation pulse included in the common driving signal can be corrected for and supplied to each of the ejectors.

In the foregoing second aspect, the liquid ejecting apparatus may further include a second ejector having a nozzle that ejects a liquid, a pressure chamber communicating with the nozzle, and a pressure generating element that causes pressure of the liquid within the pressure chamber to fluctuate, and the driving waveform selector may be configured to supply the fourth potential of the fourth element of the pressure generation pulse to the pressure generating element of the first ejector at the time of the generation of the third pulse of the selection control signal and supply the fourth potential of the fourth element of the pressure generation pulse to the pressure generating element of the second ejector at the time of the generation of the fourth pulse of the selection control signal.

According to the foregoing second aspect, when an ejection characteristic of the first ejector is different from an ejection characteristic of the second ejector, it is possible to suppress a variation in the ejection characteristics of the first and second ejectors.

The disclosure is not limited to the aspects as the foregoing liquid ejecting apparatuses. For example, the disclosure can be achieved as various aspects, such as methods for controlling the liquid ejecting apparatuses and methods for driving the pressure generating elements included in the liquid ejecting apparatuses.

What is claimed is:

1. A liquid ejecting apparatus comprising:

a first ejector having a nozzle that ejects a liquid, a pressure chamber communicating with the nozzle, and a pressure generating element that causes pressure of the liquid within the pressure chamber to fluctuate;

a common driving signal generator configured to generate a common driving signal having a pressure generation pulse including a first element maintained at a first potential, a second element succeeding the first element and maintained at a second potential different from the first potential, and a third element succeeding the second element and maintained at a third potential different from the second potential;

a selection control signal generator configured to generate a selection control signal including a first pulse and a second pulse succeeding the first pulse in a time period corresponding to the second element of the pressure generation pulse; and a driving waveform selector configured to supply the second potential of the second element of the pressure generation pulse to the pressure generating element of the first ejector at the time of the generation of a pulse selected from the first and second pulses of the selection control signal.

2. The liquid ejecting apparatus according to claim 1, further comprising:

a second ejector having a nozzle that ejects a liquid, a pressure chamber communicating with the nozzle, and a pressure generating element that causes pressure of the liquid within the pressure chamber to fluctuate, wherein the driving waveform selector is configured to supply the second potential of the second element of the pressure generation pulse to the pressure generating element of the first ejector at the time of the generation of the first pulse of the selection control signal and supply the second potential of the second element of the pressure generation pulse to the pressure generating element of the second ejector at the time of the generation of the second pulse of the selection control signal.

3. A liquid ejecting apparatus comprising:

a first ejector having a nozzle that ejects a liquid, a pressure chamber communicating with the nozzle, and a pressure generating element that causes pressure of the liquid within the pressure chamber to fluctuate;

a common driving signal generator configured to generate a common driving signal having a pressure generation pulse including a first element maintained at a first potential, a second element succeeding the first element and maintained at a second potential different from the first potential, a third element succeeding the second element and maintained at a third potential different from the second potential, and a fourth element succeeding the third element and maintained at a fourth potential different from the third potential;

a selection control signal generator configured to generate a selection control signal including a third pulse and a fourth pulse succeeding the third pulse in a time period corresponding to the fourth element of the pressure generation pulse; and a driving waveform selector configured to supply the fourth potential of the fourth element of the pressure generation pulse to the pressure generating element of the first ejector at the time of the generation of a pulse selected from the third and fourth pulses of the selection control signal.

4. The liquid ejecting apparatus according to claim 3, further comprising:

a second ejector having a nozzle that ejects a liquid, a pressure chamber communicating with the nozzle, and a pressure generating element that causes pressure of the liquid within the pressure chamber to fluctuate, wherein the driving waveform selector is configured to supply the fourth potential of the fourth element of the pressure generation pulse to the pressure generating element of the first ejector at the time of the generation of the third pulse of the selection control signal and supply the fourth potential of the fourth element of the pressure generation pulse to the pressure generating element of the second ejector at the time of the generation of the fourth pulse of the selection control signal.

* * * * *